United States Patent [19]

Brown

[11] Patent Number: 4,679,994

[45] Date of Patent: Jul. 14, 1987

[54] PISTON VACUUM PUMP

[75] Inventor: George E. Brown, Niles, Mich.

[73] Assignee: Allied Corporation, Morristown, N.J.

[21] Appl. No.: 507,891

[22] Filed: Jun. 27, 1983

Related U.S. Application Data

[63] Continuation of Ser. No. 242,000, Mar. 9, 1981, abandoned.

[51] Int. Cl.[4] ..... F04B 21/02; F04B 21/04

[52] U.S. Cl. ..... 417/525; 417/534; 417/DIG. 1

[58] Field of Search ..... 417/525, 534, DIG. 1; 92/248

[56] References Cited

U.S. PATENT DOCUMENTS

| | | | |
|---|---|---|---|
| 264,312 | 9/1882 | Marchand | 417/525 |
| 1,295,529 | 2/1919 | Lawhead | 417/525 |
| 3,499,601 | 2/1968 | Laerdal | 417/525 |
| 3,779,672 | 12/1973 | Schroeder | 92/248 |
| 3,800,675 | 4/1974 | Jacobs | 417/525 |
| 3,808,955 | 5/1974 | Hamada et al. | 417/DIG. 1 |
| 4,072,210 | 2/1978 | Chien | 417/525 |

FOREIGN PATENT DOCUMENTS

| | | | |
|---|---|---|---|
| 0086953 | 7/1980 | Japan | 417/DIG. 1 |

*Primary Examiner*—Alan Cohan
*Assistant Examiner*—John A. Rivell
*Attorney, Agent, or Firm*—Ken C. Decker

[57] ABSTRACT

A piston vacuum pump includes a housing (40) which is extruded from aluminum to form a bore (42) for movably receiving a piston (44). The piston is made from a plastic material to define a sealing interface with the aluminum housing in the absence of additional sealing rings and lubricants. The extruded housing is also provided with an opening (64) to receive an input member (90) and to provide for fluid communication through the pump.

4 Claims, 3 Drawing Figures

PISTON VACUUM PUMP

This is a continuation, of application Ser. No. 242,000, filed Mar. 9, 1981, now abandoned.

The invention relates to a piston vacuum pump which is operable to substantially maintain a vacuum within an accumulator. The pump is coupled to a motor and communicates with the accumulator and a reservoir. A control unit is responsive to the condition of the accumulator to control operation of the motor and pump.

Piston pumps have heretofore included a housing with a bore for receiving a piston and the piston cooperates with the housing to form chambers. The piston includes valve assemblies which are pressure responsive so that reciprocal movement of the piston alternately expands and contracts the chambers. As illustrated in Design News, Sept, 8, 1980, pages 200 and 201, seals and lubricant are carried within the piston pump housing, together with a plurality of bearing assemblies so that the piston pump housing requires several modifications to accomodate seals, lubricants and bearing assemblies. Therefore, manufacturing the piston pump housing is rather costly and time consuming.

The present invention provides a double acting piston pump which is operable in both directions of movement for the piston to communicate fluid from an accumulator to a reservoir in order to substantially maintain a source of vacuum within the accumulator. The pump defines a simple and lightweight construction providing a housing defining a cylindrical bore in a piston pump, a housing defining a cylindrical bore for movably receiving a piston, the piston cooperating with the housing to substantially define a pair of variable volume chambers, the housing including an inlet and an outlet and the piston defining passages providing communication between the inlet and outlet, a first pair of valve assemblies communicating with one of the pair of variable volume chambers, a second pair of valve assemblies communicating with the other variable volume chamber, an input member extending into the housing bore to reciprocate the piston therein, the piston reciprocating within the housing bore and cooperating with the first and second pair of valve assemblies to communicate fluid pressure from the inlet to the outlet via the piston passages and the variable volume chambers, characterized by said piston being made from a plastic material, said cylindrical housing including an aluminum extrusion defining the wall of the housing cylindrical bore, said plastic piston slidably engaging the bore wall of said aluminum extrusion to define a sealing interface therebetween which is free of additional sealing members, and said plastic piston also slidably engaging the wall of said aluminum extrusion in the absence of any lubricant therebetween.

In a preferred embodiment, a pair of covers define cavities and the aluminum extrusion includes passage means communicating the pair of cavities. The aluminum extrusion also includes other passage means communicating an accumulator with a central cavity within the piston and a motor extends through an extrusion opening and the other passage means to operatively engage the piston.

It is an advantage of the present invention that the piston is made from lightweight materials such as aluminum and plastic. Also the selection of materials permits operation of the pump in the absence of added seals and/or lubricant.

Two ways of carrying out the invention are illustrated in the accompanying drawings, in which.

Figure 1:
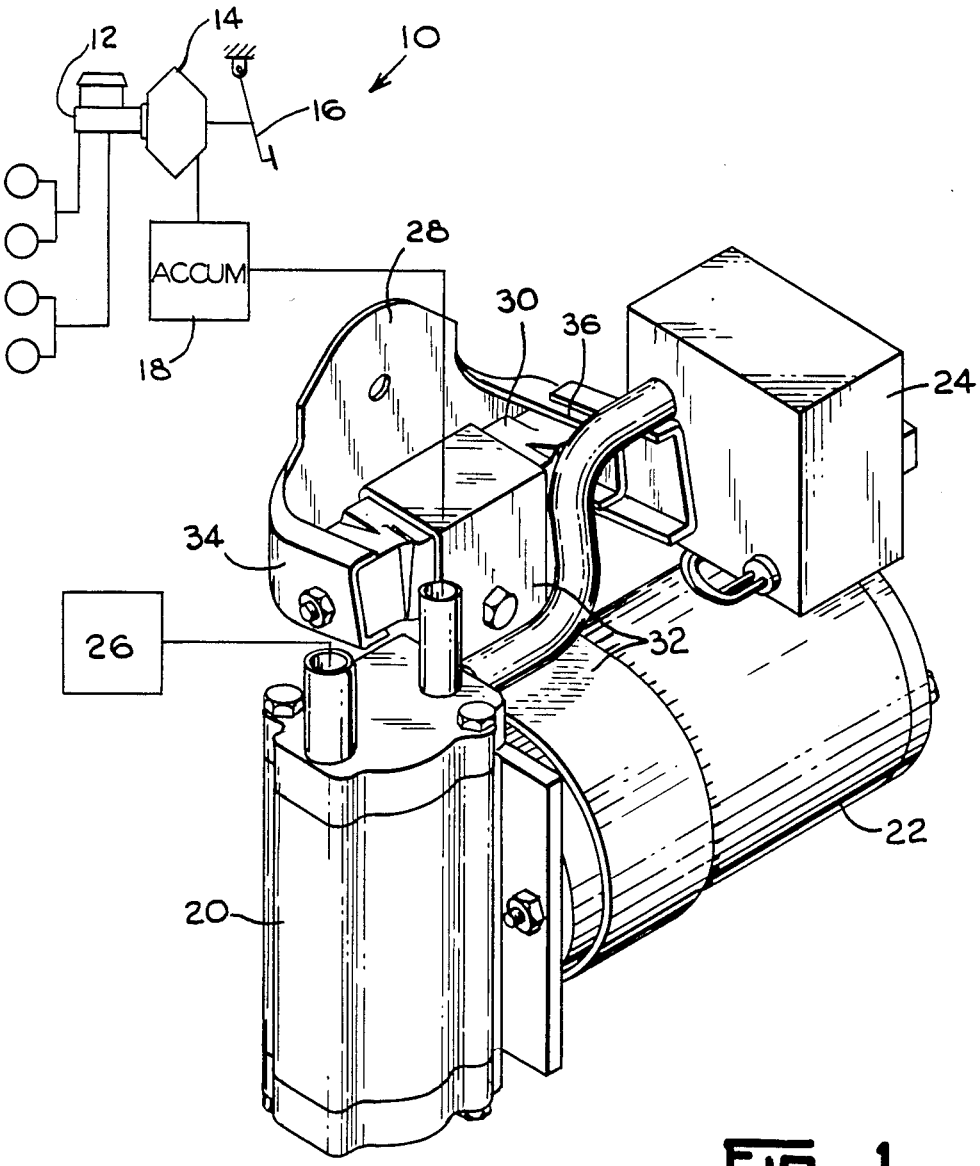
FIG. 1 is a perspective view of a vacuum brake booster system utilizing an electric motor driven piston pump constructed in accordance with the present invention.

In FIG. 1 a brake system 10 includes a master cylinder 12 fluidly communicating with a set of brake shoes for the front and rear wheels of a vehicle (not shown). A vacuum booster 14 is coupled to a brake pedal 16 to proide a power assist upon actuation of the brake pedal. The vacuum booster 14 communicates with an accumulator 18 which, in turn, communicates with a pump 20. An electric motor 22 operates the pump 20 and a control unit 24 is responsive to the output of the pump to control the electric motor 22. The pump exhausts to a reservoir 26 which can be the intake manifold of the vehicle engine, or in the alternative the pump can exhaust to atmosphere. A bracket 28 includes a resilient mounting 30 with a band 32 for securing the electric motor and pump. The bracket 28 is provided with a pair of arms 34, 36, one of which supports the control unit 24.

Figure 2:
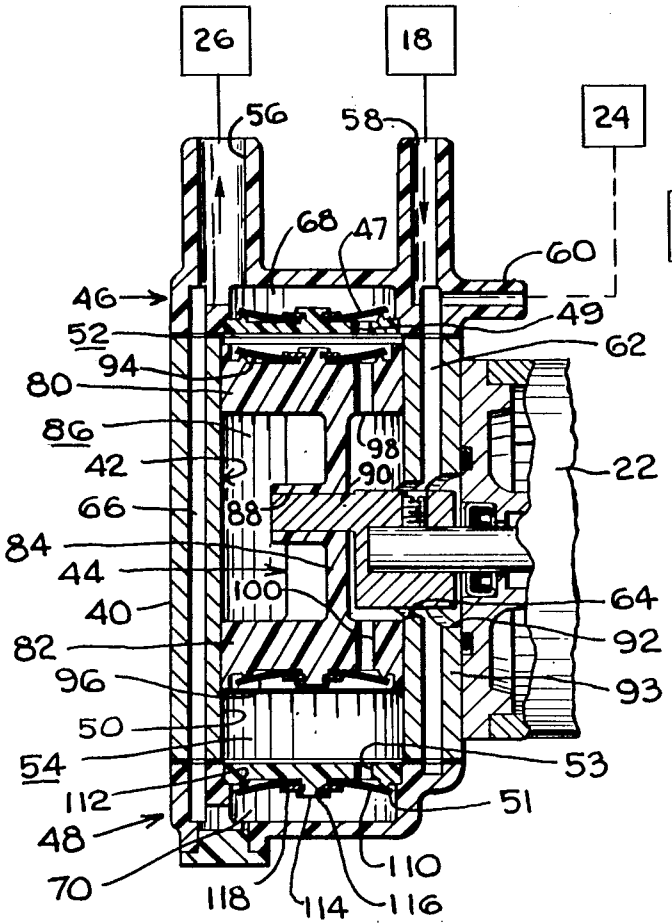
FIG. 2 is a cross-sectional view of the piston pump utilized in FIG. 1 with the other parts of Figure schematically represented.

Turning to FIG. 2, the pump 20 is shown in cross section. The pump comprises a cylindrical housing 40 with a bore 42 extending therethrough. A piston 44 is movably disposed within the bore. To enclose the piston within the bore a pair of covers 46 and 48 are secured to the ends of the housing 40. The pair of covers cooperate with the piston 44 and the wall 50 of bore 42 to substantially define a pair of variable volume chambers 52 and 54. The cover 46 also defines a first port 56 communicating with the reservoir 26, a second port 58 communicating with the accumulator 18, and a third port 60 communicating with the control unit 24. The housing 40 and cover 46 include a first passage 62 communicating port 58 with port 60, accumulator 18 with control unit 24 and with bore 42 via a housing opening 64. A second passage 66 communicates cover 46 with cover 48. Also cover 46 defines a cavity 68, cad 48 defines a cavity 70, the purpose of which will be explained hereinafter, and the second passage 66 communicates cavity 68 with cavity 70. Cover 46 carries a flapper check valve assembly 47 and includes a passage 49 communicating the variable volume chamber 52 with the flapper check valve assembly 47. Likewise, cover 48 carries a flapper check valve assembly 51 and includes a passage 53 communicating the variable volume chamber 54 with the flapper check valve assembly 51.

The piston 44 is substantially H-shaped with the bore 42 disposed in a horizontal axis or substantially I-shaped with the bore 42 disposed in a vertical axis to define a pair of heads 80 and 82 which movably and sealingly engage the wall 50 of bore 42 to form the variable volume pressure chambers 52 and 54. The pair of heads 80 and 82 are connected by an intermediate portion 84 and also are separated by a central cavity 86 in communication with opening 64 and passage 62. The head intermediate portion 84 is provided with a slot 88 for receiving an eccentric output rod 90 of the motor 22. The motor 22 includes a housing which sealingly engages the outer surface of the housing 40 to seal an opening 92 which receives the motor output rod 90. The opening 92 is provided on a flange 93, see FIG. 1, which is integrally formed with the housing 40. Each head carries a flapper check valve assembly 94 and 96 and each head includes a passage 98 and 100 communicating the central cavity 86 with the respective flapper check valves.

The flapper check valve assemblies 47, 51, 94 and 96 are similar. Each assembly comprises an annular flexible disc 110 which in the rest position is yieldably deflected by annular seats 112 away from its associated passage in the heads and caps. Projections 114 from the heads and covers define recesses 116 for receiving retaining washers 118. The annular flexible discs 110 are centrally apertured to fit on the projections so that upon staking, or other suitable attaching methods, the projections overlap the retaining washers and the annular flexible discs to secure the latter to the heads and covers.

In operation the electric motor 22 controls the reciprocal movement of the piston 44 within the housing 40. When the control unit 24 senses a pressure level within the passage 62 and accumulator 18 above the desired vacuum level, it switches the electric motor on to reciprocate the piston 44 within the housing 40 In the position of FIG. 2, the piston 44 is located substantially at its top position so that the chamber 52 is fully contracted and the chamber 54 is fully expanded. With the piston moving downward, the chamber 54 is contracted to increase fluid pressure therein. The valve 96 prevents flow from the chamber 54 to the central cavity 86 while the valve 51 permits flow from the chamber 54 to the cavity 70. From the cavity 70, any fluid pressure communicated thereto is exhausted to the reservoir 26 via the passage 66. As for chamber 52, the downwardly moving piston expands this chamber to reduce fluid pressure therein. The valve 94 permits fluid flow from central cavity 86 to chamber 52 via passage 98. With valve 47 preventing flow from cavity 68 to chamber 52, the expanding chamber undergoes a fluid pressure reduction to create a pressure differential across valve 94, thereby allowing any fluid pressure within central cavity 86, which is greater than that created in expanding chamber 52, to communicate with the chamber 52. Therefore, the downwardly moving piston communicates fluid pressure from the accumulator to the chamber 52 via passage 62, opening 64, central cavity 86 and passage 98 in order to decrease the fluid pressure level within the accumulator.

When the piston 44 reaches its bottom position, the chamber 52 will be fully expanded so that further withdrawal of fluid pressure from central cavity 86 and accumulator 18 will terminate. Also, the chamber 54 will be fully contracted so that further expulsion of fluid pressure therein to cavity 70 and reservoir 26 will terminate. When the piston starts moving upward, the chamber 54 will expand to withdraw fluid pressure from central cavity 86 and accumulator 18 via head 82 in a similar manner as head 80 when the piston is moving downward. Also, the upwardly moving piston will contract chamber 52 to expel the fluid pressure communicated therein during downward movement of the piston to the cavity 68 and reservoir 26.

In both directions of movement for the piston 44, the accumulator 18 and space 86 are depressurized to create a vacuum therein.

In accordance with one form of the present invention, the housing 40 is extruded from aluminum to simultaneously form the bore 42, the passages 62 and 66 and the flange 93. The piston 44 and the covers 46 and 48 are made from plastic materials. The plastic material for the piston is selected to be compatible with the aluminum extruded housing. That is, the aluminum and selected plastic material will have a low coefficient of friction therebetween and the thermal coefficient of expansion for the selected plastic material will be substantially the same as that for aluminum. For example, a preferred example for the present invention provides a plastic material for the piston and covers in a NYLON filed with 15% PTFE and 30% carbon or glass fibers. Another example for the plastic material is PPS or polyphenolene sufide, which is similar to RYTON, manufactured by Phillips Chemical Corporation, provided this material is also filed with 15% PTFE and 30% carbon or glass fibers. With the combination of an aluminum housing and a plastic piston, it is possible to provide a sealing interface between the piston and housing in the absence of any additional sealing members. Also, because of the substantially frictionless engagement between the plastic piston and aluminum housing, it is believed that lubricants can be omitted from the housing. Therefore, the pump 20 of the present invention is a dry piston pump with inherent sealing interfaces between the piston and the housing.

Figure 3:
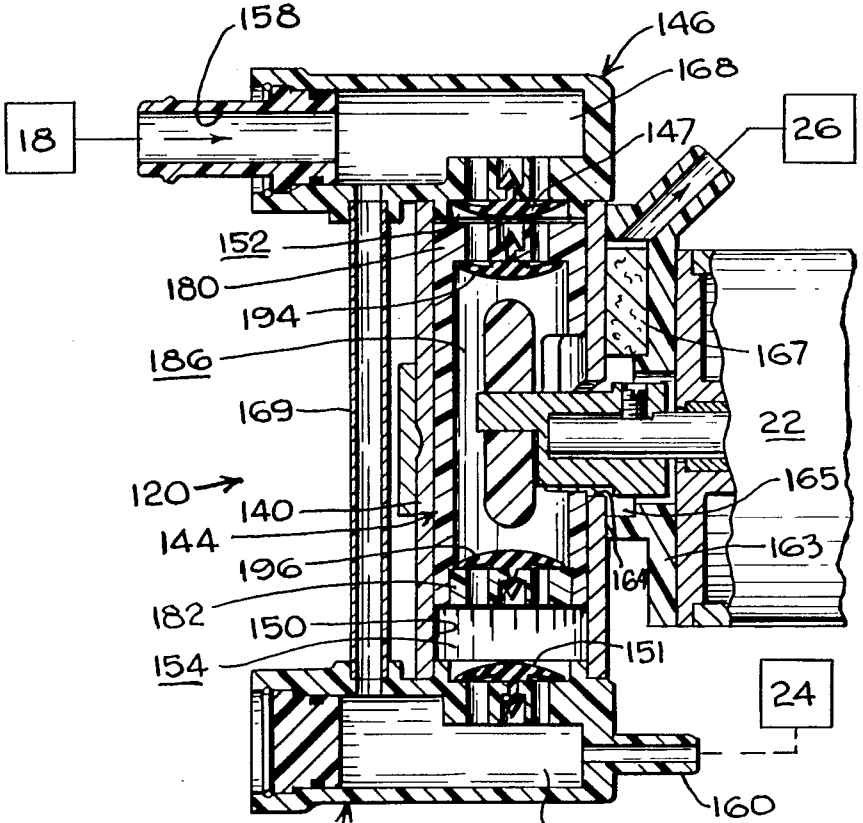
FIG. 3 is a view similar to FIG. 2 showing an alternative embodiment for the piston pump.

In the alternative embodiment of FIG. 3, the flapper check valve assemblies are reversed and the piston and covers are modified to reverse the flow of fluid through the pump. Similar parts for the pump are numbered the same as FIG. 1 plus one hundred. The pump 120 movably supports a piston 144 in a bore 150. The piston 144 forms a central cavity 186 with heads 180 and 182 carrying valve assemblies 194 and 196. Covers 146 and 148 engage the housing 140 of the pump to close the bore 150. The covers carry valve assemblies 147 and 151 and define cavities 170 and 168. The cover 146 defines a port 158 communicating with the accumulator 18 while the cover 148 defines a port 160 communicating with the control unit 24. The provision of the port 160 in cover 148 is different from the location of port 60 in FIG. 1 in cover 46. An opening 164 in the housing 140 receives an output rod of motor 22 and an adapter 163 couples the motor 22 to the pump 120. The adapter 163 also forms a passage 165 with a filter 167 for communicating the central cavity 186 with the reservoir 26. A conduit 169 communicates cavity 168 with cavity 170.

The operation of pump 120 differs from the operation of pump 20 in that the flow of fluid within housing 140 is from the variable volume chambers 152 and 154 to the central cavity 186. This is the reverse of fluid flow in pump 20. However, the piston 144 is similar to pump 44 in that both ends of the piston are provided with valve assemblies to withdraw fluid pressure from the accumulator 18 in both directions of movement for the piston 144.

In both embodiments it is proposed that the piston and covers be made from a plastic material while the housing is extruded from aluminum. In selecting the appropriate plastic material it is important to select a plastic with a coefficient of heat expansion substantially equal to that for aluminum. It is also within the scope of the invention that the covers are secured to the housing and, as such, are a part of the housing.

In an alternative form of the present invention, the housing 40 is extruded from a plastic material which also is used to form the piston and covers. One type of plastic material considered for the plastic housing is the PPS filled material referred to above. With the housing and covers made from the same or substantially similar materials, it is possible to utrasonically weld these parts together.

I claim:

1. In a piston pump, a housing defining a cylindrical bore for movably receiving a piston, the piston cooperating with the housing to substantially define a pair of variable volume chambers, the housing including an inlet and an outlet and the piston defining passages providing communication between the inlet and outlet, a first pair of valve assemblies communicating with one of the pair of variable volume chambers, a second pair of valve assemblies communicating with the other variable volume chambers, an input member extending into the housing bore to reciprocate the piston therein, the piston reciprocating within the housing bore and cooperating with the first and second pair of valve assemblies to communicate fluid pressure from the inlet to the outlet via the piston passages and the variable volume chambers, characterized by said housing including a pair of passages extending parallel from one end of said housing to the other end of said housing, one of said pair of passages defining a portion of the inlet and the other of said passages defining a portion of the outlet, said pair of passages being offset from said housing cylindrical bore and the input member intersects said one passage to extend through a housing opening into said cylindrical bore whereby fluid communication is provided from said one passage to said cylindrical bore via said housing opening.

2. The piston pump of claim 1 characterized by said housing opening providing for communication between the inlet and the outlet.

3. In a piston pump, the combination of a housing forming a bore, a piston reciprocally disposed within said bore, a pair of covers engageable with said housing to substantially enclose said piston within the bore, said pair of covers cooperating with said housing and said piston to substantially define a pair of variable volume chambers, said piston defining a central cavity, an input member extending into said central cavity and engaging said piston to impart reciprocating movement thereto, said piston carrying a pair of check valves permitting one way fluid communication between said central cavity and said pair of variable volume chambers, and said housing including an opening for receiving said input member, said opening also providing fluid communication directly between said central cavity and the outside of the bore when said piston is reciprocating, the fluid communication directly between said central cavity and the outside of the bore being primarily through said opening when said piston is reciprocating.

4. In a piston pump, a housing having an axially extending bore therein, a piston movably disposed within the bore, the piston defining a first end and a second end forming a center cavity therebetween, a first cover secured to the housing and defining a first variable volume chamber, a second cover secured to the housing and defining a second variable volume chamber, and a motor secured to the housing and including an input member extending into the bore to engage the piston, the piston first and second ends including valve means to control fluid communication between the center cavity and the variable volume chambers said housing defining a pair of axially extending passages extending from said first cover to said second cover and offset from said housing bore, one of said axially extending passages communicating with said center cavity via a housing opening to provide for fluid communication between said pair of variable volume chambers and said one passage via said center cavity, and said other passage communicating said covers with each other.

* * * * *